US005786667A

United States Patent [19]

Simpson et al.

[11] Patent Number: 5,786,667

[45] Date of Patent: Jul. 28, 1998

[54] ELECTRODELESS LAMP USING SEPARATE MICROWAVE ENERGY RESONANCE MODES FOR IGNITION AND OPERATION

[75] Inventors: James E. Simpson, Gaithersburg; Wayne G. Love, Olney, both of Md.

[73] Assignee: Fusion Lighting, Inc., Rockville, Md.

[21] Appl. No.: 694,778

[22] Filed: Aug. 9, 1996

[51] Int. Cl.[6] ..... H01J 65/04

[52] U.S. Cl. ..... 315/39; 315/344

[58] Field of Search ..... 315/39, 248, 344; 333/227

[56] References Cited

U.S. PATENT DOCUMENTS

| | | | |
|---|---|---|---|
| 3,942,058 | 3/1976 | Haugsjaa et al. | 315/39 X |
| 4,160,144 | 7/1979 | Kasyhap et al. | 333/227 X |
| 4,749,915 | 6/1988 | Lynch et al. | 315/248 |
| 4,887,008 | 12/1989 | Wood | 315/39 |
| 4,887,192 | 12/1989 | Simpson et al. | 315/248 X |
| 4,954,755 | 9/1990 | Lynch et al. | 315/248 |
| 4,975,625 | 12/1990 | Lynch et al. | 315/344 |
| 5,227,698 | 7/1993 | Simpson et al. | 315/248 |
| 5,334,913 | 8/1994 | Ury et al. | 315/39 X |
| 5,361,274 | 11/1994 | Simpson et al. | 315/248 X |

FOREIGN PATENT DOCUMENTS

| | | | |
|---|---|---|---|
| 56-126250 | 10/1981 | Japan | 315/39 |
| 61-159805 | 7/1986 | Japan | 333/227 |

*Primary Examiner*—Robert Pascal
*Assistant Examiner*—Justin P. Bettendorf
*Attorney, Agent, or Firm*—Pollock, Vande Sande & Priddy

[57] ABSTRACT

An apparatus which couples microwave energy to an electrodeless lamp. A source of microwave energy is connected to a wave guide having a slot along one wall thereof. A nominally cylindrical cavity enclosing an electrodeless lamp is closed at one end and coupled at a second end to the slot. The nominally cylindrical cavity has a non cylindrical surface portion which increases coupling from said slot to a second resonant mode which is orthogonal to a first primary resonant mode, creating a high amplitude standing wave in the region of the electrodeless lamp. Once ignition of the lamp occurs, the impedance of the lamp decreases significantly, and most of the microwave power for sustaining illumination is coupled to the electrodeless lamp in the first resonant mode producing a substantially matched load to said microwave source.

25 Claims, 6 Drawing Sheets

ELECTRODELESS LAMP USING SEPARATE MICROWAVE ENERGY RESONANCE MODES FOR IGNITION AND OPERATION

The present invention is directed to an apparatus which provides a high intensity electric field component for reliably starting an electrodeless lamp.

Specifically, a microwave circuit is provided which will transfer microwave energy in a first mode for creating the high intensity electric field for igniting the lamp, while providing a second, impedance matched mode for delivering energy to an ignited lamp.

In recent years electrodeless light sources have found use in such diverse application as semiconductor device fabrication, curing various coatings and ink, as well as sources for providing visible light. In general, these light sources comprise an envelope or bulb containing a plasma forming medium. When the envelope is placed in a microwave energy field the gases within the envelope ionize. A low pressure plasma discharge forms within the bulb, heating the envelope, vaporizing materials such as sulfur within the envelope to generate light.

Sulfur based electrodeless lamps may include any combination of sulfur and selenium as a light producing fill along with a rare gas, which may be argon or xenon. The sulfur and selenium initially condenses on the wall of the envelope and the rare gas is used to start the discharge. The electric field provided by a microwave source ionizes the rare gas, forming the low pressure plasma. The low pressure plasma in turn heats the envelope and allows the sulfur and selenium to vaporize raising the plasma pressure and forming a highly efficient light source.

The light output of sulfur based electrodeless lamps can be increased by raising the mass of gas within the bulb. The increased mass reduces the thermal conductivity of the plasma and results in less power loss through the wall of the bulb. In order to raise the mass of gas within the bulb, the amount of sulfur or selenium cannot be increased without compromising control over the color of the light. Thus, it is the rare gas mass and pressure which is the variable which may be adjusted to provide the higher light output. Raising the pressure of the heavy rare gases also raises the electric field necessary to start the ionization of the rare gas. Microwave circuitry which generates an electric field sufficient to start a low pressure, argon gas for instance, will not ignite a higher pressure xenon gas used in the electrodeless lamp. In order to light higher pressure lamps, a much higher electric field must be obtained. The obvious solution of increasing the microwave power to obtain a higher electric field is undesirable because of the increased cost. A microwave circuit is necessary which will provide a higher electric field from the same conventional microwave sources used to power the lower pressure, lower light producing electrodeless lamps.

Complications result when attempting to raise the electric field intensity for starting the ionization of a lamp located in a cavity coupled to a source of microwave energy. Before ignition occurs, the lamp exhibits a highly reactive/capacitive reactance which is coupled to the microwave source. If the microwave circuity is tuned to provide the high electric field starting conditions for the lamp, once the lamp ignites, a more resistive, much lower impedance load is then presented to the microwave source. Retuning of the microwave circuitry following ignition is possible, but provides a distinct disadvantage for commercial applications. The present invention seeks to provide for the high starting electric field conditions for igniting a high pressure electrodeless lamp, while providing for a substantially impedance matched condition to the microwave source once the electrodeless lamp is ignited.

SUMMARY OF THE INVENTION

In accordance with the invention, a microwave circuit is provided which will excite an electrodeless lamp with a high electric field prior to and during the ignition of the electrodeless lamp, while providing an impedance match to the electrodeless lamp following ignition. The microwave circuit couples a microwave source to a nominally cylindrical cavity which contains the electrodeless lamp. The nominally cylindrical cavity is modified to support first and second orthogonal resonant modes of microwave energy. The first mode supplies sustaining microwave energy to the ignited lamp, while the second mode provides a high electrostatic field for igniting the lamp. Once it is ignited, the electrodeless lamp emits light through various apertures contained in the surface of the cavity. The change in impedance of the lamp from its pre-ignition state, to its ignition state, results in more power being transferred in the first mode than in the second mode which was used to start the lamp.

The first and second modes may be orthogonal transverse electric $TE_{111}$ resonant modes which are supported in a nominally cylindrical cavity. The nominally cylindrical cavity is coupled to the microwave source through a linear slot located in a section of waveguide connected to the microwave source. By varying the shape of the nominally cylindrical cavity, first and second orthogonal modes supported by the cylindrical cavity are rotated, slightly increasing the coupling to the second mode. During ignition, the second mode delivers a high amplitude electric field in the form of a high standing wave within the cavity to the lamp which exhibits a high reactance. Following ignition of the lamp and a lowering of the impedance thereof, a matched or substantially matched impedance is reflected via the first resonant mode back to the microwave source.

DESCRIPTION OF THE PREFERRED EMBODIMENT

Figure 1:
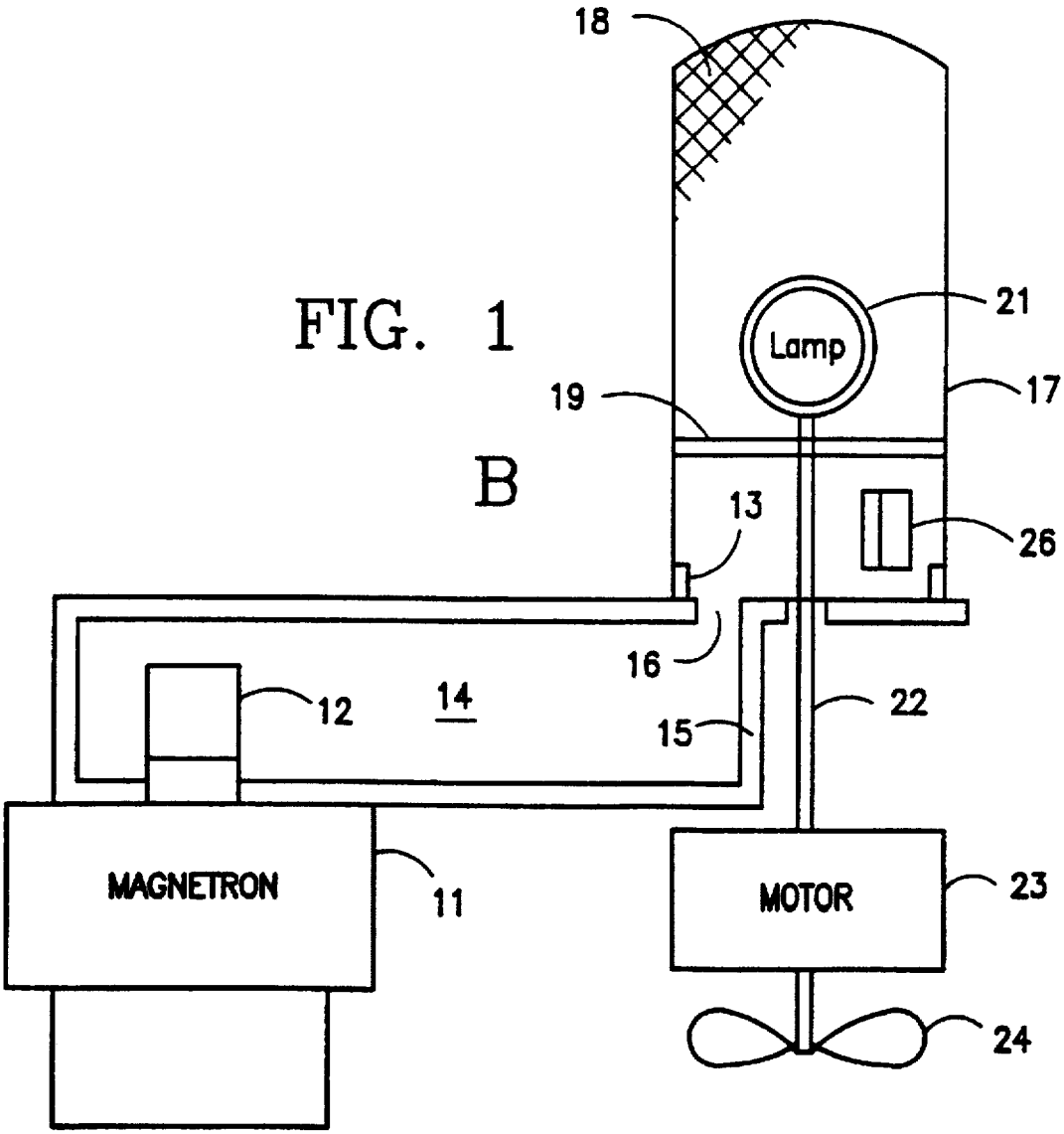
FIG. 1 illustrates a microwave source coupled through a microwave circuit of one embodiment of the invention to illuminate an electrodeless lamp.

Referring now to FIG. 1, there is shown a device for exciting an electrodeless lamp 21 with microwave energy. The device of FIG. 1 will establish a high electric field within the cylindrical cavity 18 to ionize a rare gas within the electrodeless lamp 21. The ionized gas, as is known in electrodeless lamp technology, heats the sulfur within the lamp to generate visible light. The device of FIG. 1 includes a source of microwave energy which may be a conventional magnetron 11 operating in the 2.4 Ghz frequency range. The magnetron 11 is coupled to a rectangular waveguide 14, such that energy emitted by the antenna 12 of the magnetron 11 excites a traveling wave in the waveguide 14.

Figure 2:
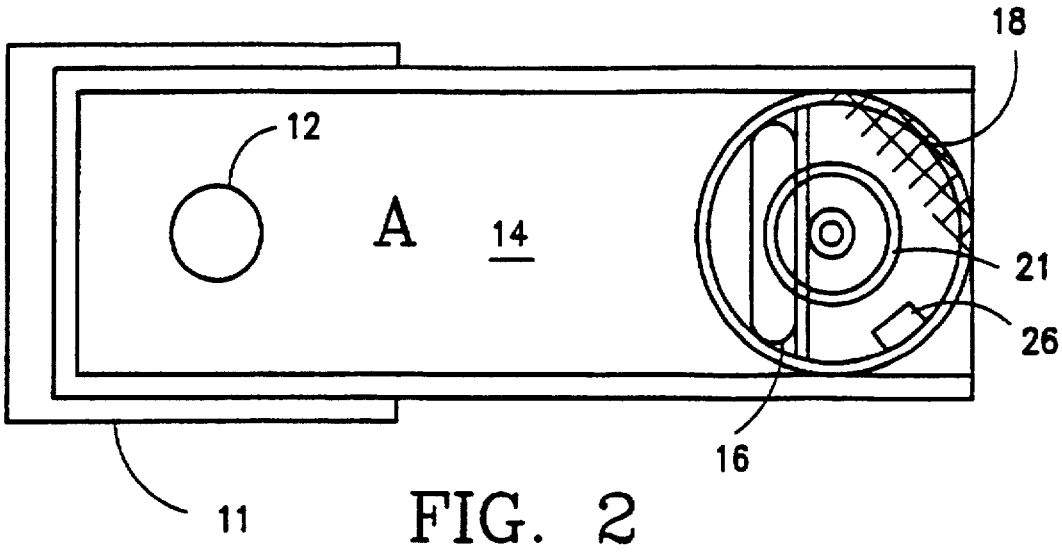
FIG. 2 is a top view of the device of FIG. 1.

The end 15 of waveguide 14 includes a longitudinal slot 16 which can be seen in FIG. 2, extending along the wide dimension of the rectangular waveguide. The longitudinal slot 16 couples microwave energy into a cylindrical cavity 18 which is formed of a wire mesh or other surface having light emitting apertures. The cylindrical cavity 18 supports a dielectric mirror 19 which enhances the total light output from the device.

The electrodeless lamp 21 is supported on a rotating shaft 22 which extends through an opening in the dielectric mirror 19. A motor 23 cooled by a fan blade 24 rotates the electrodeless lamp 21 at approximately 3000 rpm. The rotation of the lamp lowers the lamp envelope temperature to promote the life of the lamp. FIGS. 1 and 2 illustrate that the nominally cylindrical cavity 18 is connected to a flange 13 on the wall of waveguide 14, and is coupled to the slot 16, and closed at the other end with a wire mesh surface. An object 26 is in contact with the cylinder wall 17. The cylindrical cavity, as will be evident from the following explanation, maintains a nominally cylindrical shape, however, because of the object 26, the microwave resonance characteristics of the cylindrical cavity are modified by the change in symmetry made by object 26.

The effects of the modification of the cylindrical cavity 18 can be explained by observing each of two resonant modes $TE_{111}$ and $TE_{111}$ (orthogonal) which exist within a cylindrical cavity coupled to a longitudinal slot without object 26. The substantially cylindrical cavity 28 of FIG. 3 has a longitudinal axis perpendicular to a wall of a waveguide 14 and supports two resonant modes $TE_{111}$ and $TE_{111}$ (orthogonal) also shown in FIG. 3. The longitudinal slot 16 couples the E field component E1 perpendicular to the slot 16, and a smaller parallel component E2, to respective orthogonal modes of the cavity 28.

Figure 3:
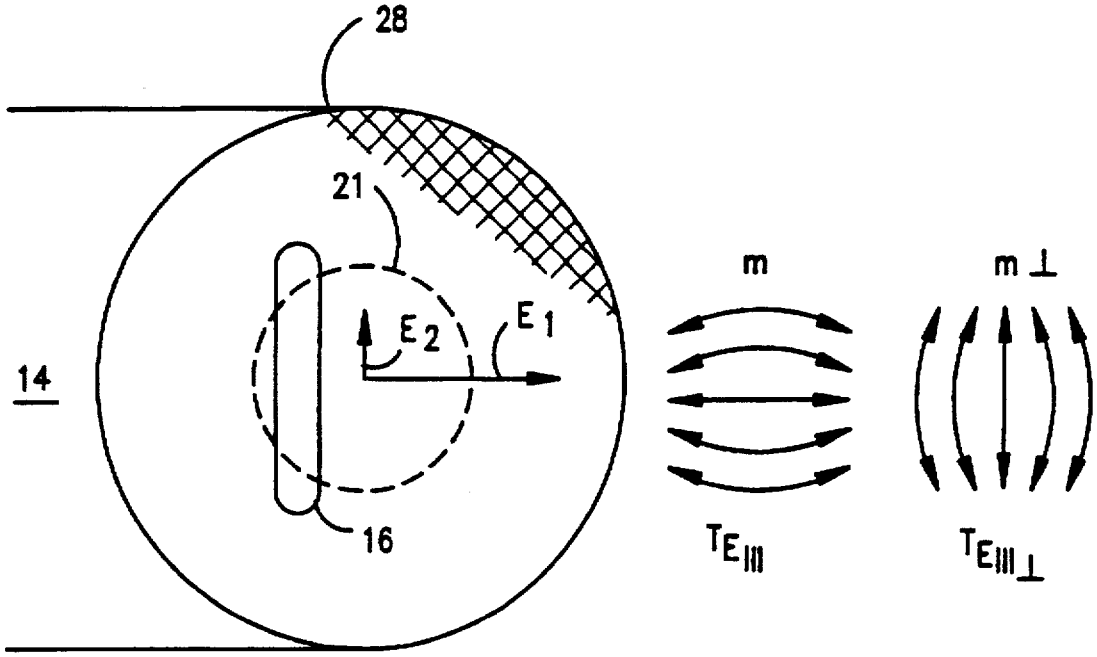
FIG. 3 illustrates the coupling of microwave energy in first and second orthogonal modes from a slot to a cylindrical cavity.
Figure 4:
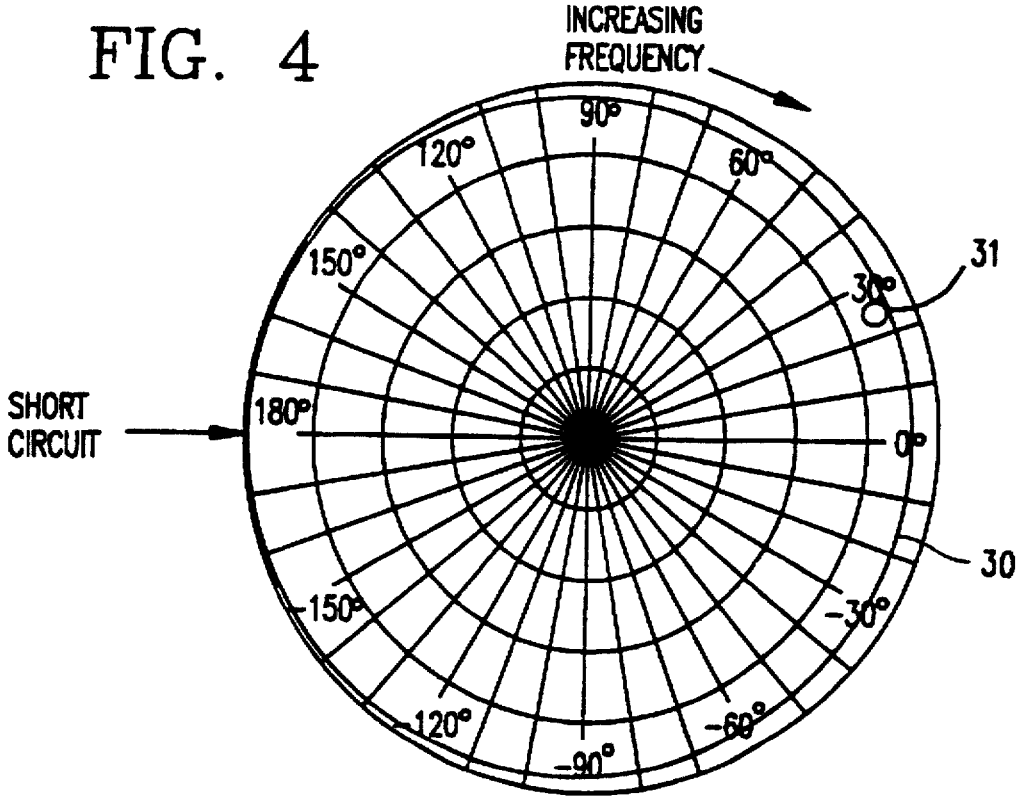
FIG. 4 illustrates the impedance reflected by a cylindrical cavity to a longitudinal slot.

As a consequence of the orientation of the electric field components E1 and E2 coupled from the waveguide 14, the primary mode excited within the cavity 28 is that shown as $TE_{111}$ in FIG. 3. The second mode $TE_{111}$ (orthogonal) is excited to a very minimal extent. FIG. 4 illustrates the impedance presented by the cavity 28, before ignition of the lamp, as a function of frequency on a polar coordinate basis. Very low as well as very high frequencies appear as short circuits to the slot 16. The locus moves clockwise as frequency increases tracing a circle 30 within the chart diameter demonstrating an over-coupled resonance to the cavity 28. As can be seen from FIG. 4, the circle 30 begins tangent to the outermost diameter of the chart, where the outermost diameter represents complete reflection of the incoming signal. As frequency increases and approaches resonance, the circle 30 moves inside of the outermost diameter, representing increased power absorption within the cavity, although reflection to the source is still large. Small distortions in the symmetry of the cavity from a true cylindrical surface adds a small loop, shown as 31 indicating more energy is being coupled to the orthogonal mode $TE_{111}$ (orthogonal) mode at a given frequency.

The distortion 31 illustrates that for a very narrow bandwidth, there is an improvement in the reflection coefficient and impedance match to the slot, suggesting that distorting the surface of the cylindrical cavity 28 from a true cylindrical surface may couple more energy to the $TE_{111}$ (orthogonal) mode thus improving the match between the loaded cavity 28 containing the electrodeless lamp 21 and the slot 16.

Figure 5:
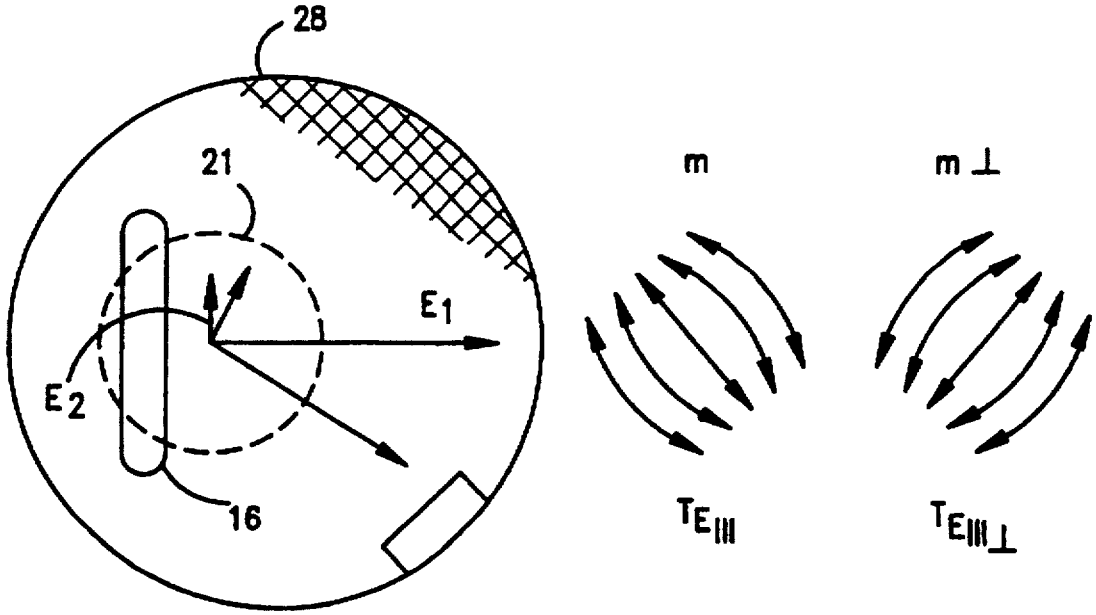
FIG. 5 illustrates the increase in coupling to the orthogonal mode of a modified cylindrical cavity from a longitudinal slot.
Figure 6:
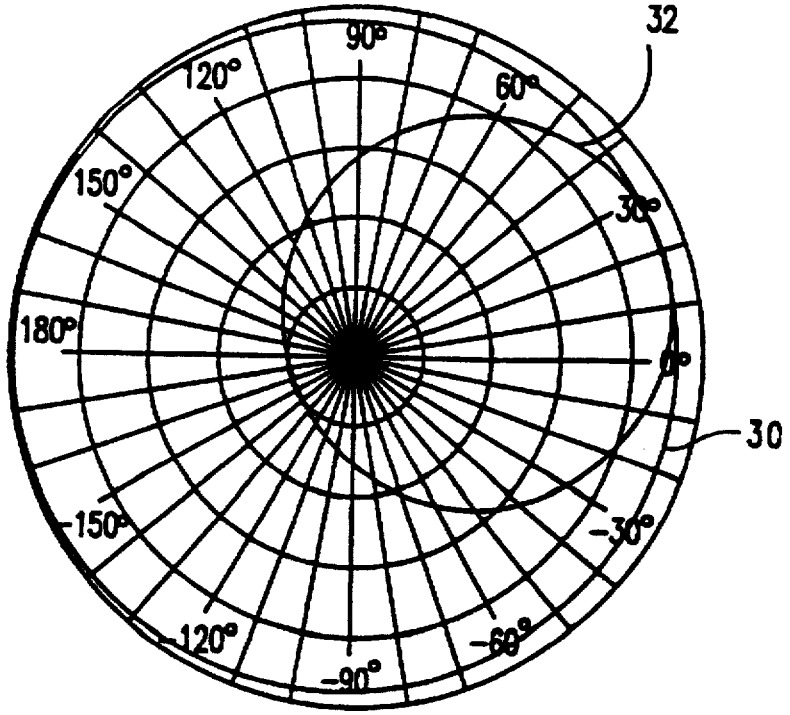
FIG. 6 illustrates the impedance seen at the slot which results from increasing the coupling energy to the orthogonal mode.

FIG. 5 demonstrates that providing the object 26, in contact with the surface of the cylindrical cavity 28, produces a cavity which is only nominally cylindrical having a distortion in its surface in the vicinity of object 26. The effect as illustrated in FIG. 5 is to rotate the axes of the first and second orthogonal resonant modes $TE_{111}$ and $TE_{111}$ (orthogonal) with respect to the slot 16. The electric field component E1 from the slot 16 increases the coupling to the $TE_{111}$ (orthogonal) mode over that shown in FIG. 3. Consequently, the circle 31 representing a distortion for the surface of cylindrical cavity 28, will resemble that of 32 shown in the impedance plot of FIG. 6. The smaller diameter circle 32 within the impedance plot approaches the center of the chart which shows that a match exists, for a very narrow frequency range between the resonant cavity structure 28 and the source of microwave radiation provided by longitudinal slot 16. The frequency of the impedance match generates a high standing wave ratio within the resonant cavity 28, which produces a large reactance between the resonant cavity 28 and the slot 16 in waveguide 14. The resonant orthogonal mode, $TE_{111}$ (orthogonal), although driven by only a fraction of the electric field E1, now receives most of the power of the magnetron and provides a very high amplitude standing wave in the vicinity of the electrodeless lamp 21. When the magnetron is operating at the resonant frequency shown in the circle 32 of FIG. 6, a very intense electric field exists within the vicinity of the electrodeless lamp 21.

Once the lamp 21 ignites, the impedance of the lamp drops dramatically from a highly capacitive-reactance to a lower, substantially resistive load of 4,000 to 5,000 Ω. The loading of the cavity 28 by the ignited lamp 21 provides an impedance match through the primary mode $TE_{111}$ for sustaining the rumination of the lamp 21. Thus, the lower bulk impedance shifts the amount of energy being transferred to the loaded cavity 28 from the orthogonal mode $TE_{111}$ (orthogonal) to the primary mode $TE_{111}$.

Thus it can be seen that for starting the ignition of the electrodeless lamp 21, the secondary orthogonal mode $TE_{111}$ (orthogonal) can be used to create the high electric fields within the cavity 28. Once ignition occurs, the impedance reflected back to the microwave slot 16 reduces the effective microwave power transfer in the secondary orthogonal mode, and power transfer to the lamp 21 is maintained by the primary $TE_{111}$ mode.

The ability to couple energy into the orthogonal mode $TE_{111}$ (orthogonal) mode results from deforming a cylindrical surface of a cylindrical cavity 18 to produce a nominally cylindrical cavity, which contains along its surface a distortion shifting the axes of the first and second orthogonal resonant modes.

Figure 8:
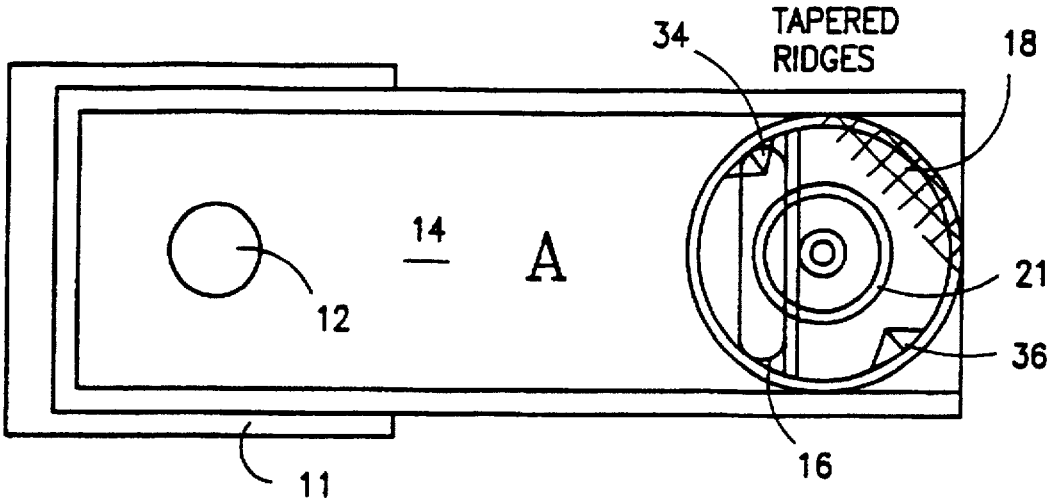
FIG. 8 is a top view of the cylindrical cavity of FIG. 7 for increasing coupling to the second resonant orthogonal mode.
Figure 7:
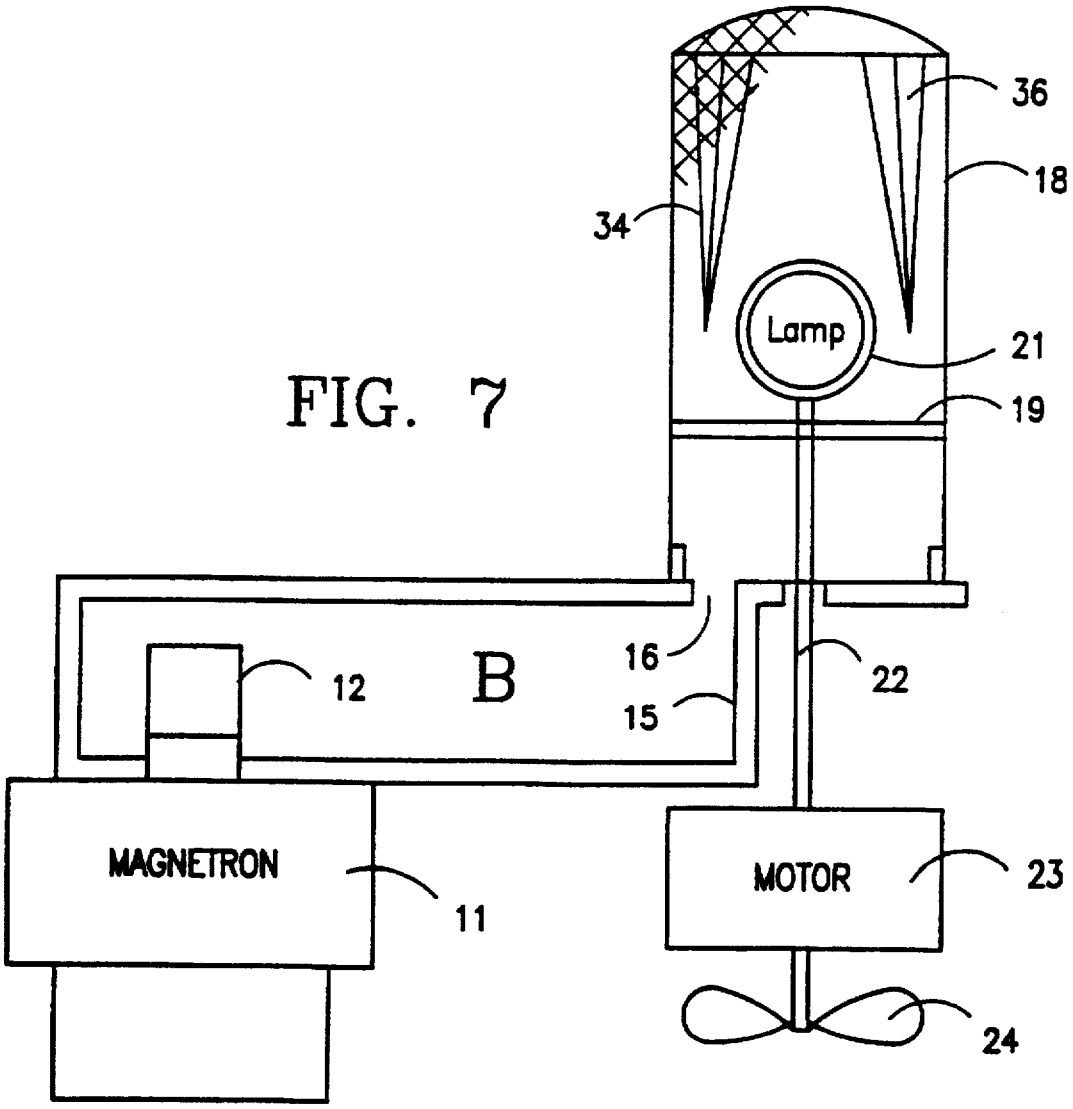
FIG. 7 illustrates another embodiment of a modified cylindrical cavity for increasing coupling to the second resonant mode.

FIGS. 7, 8, 9, 10, 11 and 12 illustrate other configurations which provide the nominally cylindrical cavity. FIGS. 7 and 8 illustrate the cylindrical cavity 18 having diametrically opposite tapered ridges 34 and 36. The tapered ridges 34, 36 are made by creasing the circular screen surface. The tapered ridges 34, 36 begin at the second closed end of a cylindrical cavity 18 and extend towards the opposite end reducing the overall diameter of the cylindrical cavity 18. The result changes the cylindrical cavity 10 to a nominally cylindrical cavity, having surface ridges 34 and 36 which increases coupling to the orthogonal resonant mode $TE_{111}$ (orthogonal). The ridger 34 and 36 present in the embodiment shown in FIGS. 7 and 8 provide for reduction in the power transfer in the second orthogonal mode $TE_{111}$ (orthogonal) following ignition of the electrodeless lamp 21. During steady state operation of the electrodeless lamp 21, much of the energy coupled in the first primary $TE_{111}$ mode is absorbed as it propagates past the electrodeless lamp 21. The effects of distortions in the cylindrical cavity surface 18 have little effect on the steady state impedance since the distortion is beyond the lamp 21. Power approaching and reflected by the tapered ridges 34 and 36 is reduced by the ionized electrodeless lamp 21, reducing the size of the reflection from tapered ridges 34 and 36.

Figure 10:
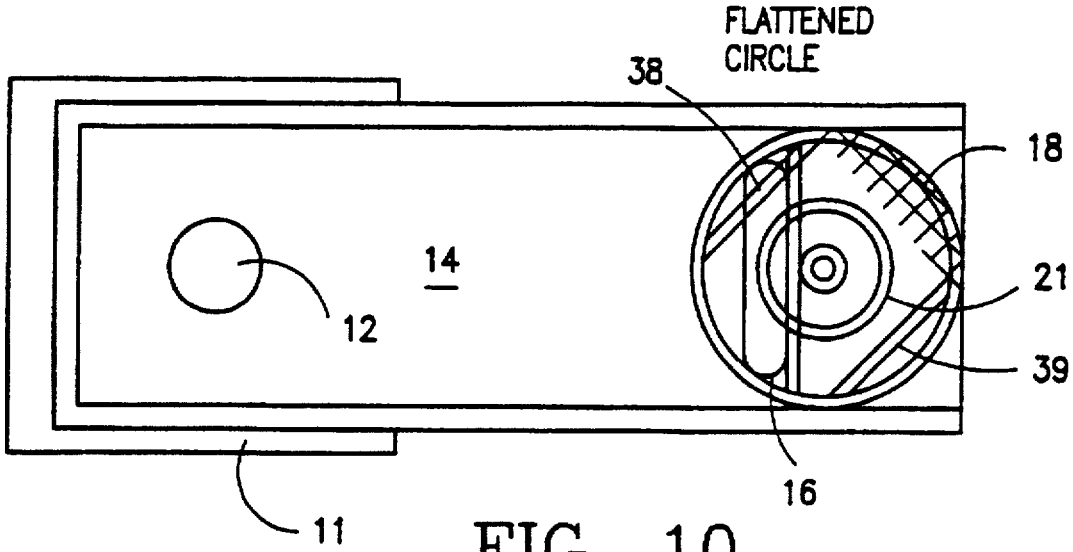
FIG. 10 is top view of FIG. 9.
Figure 9:
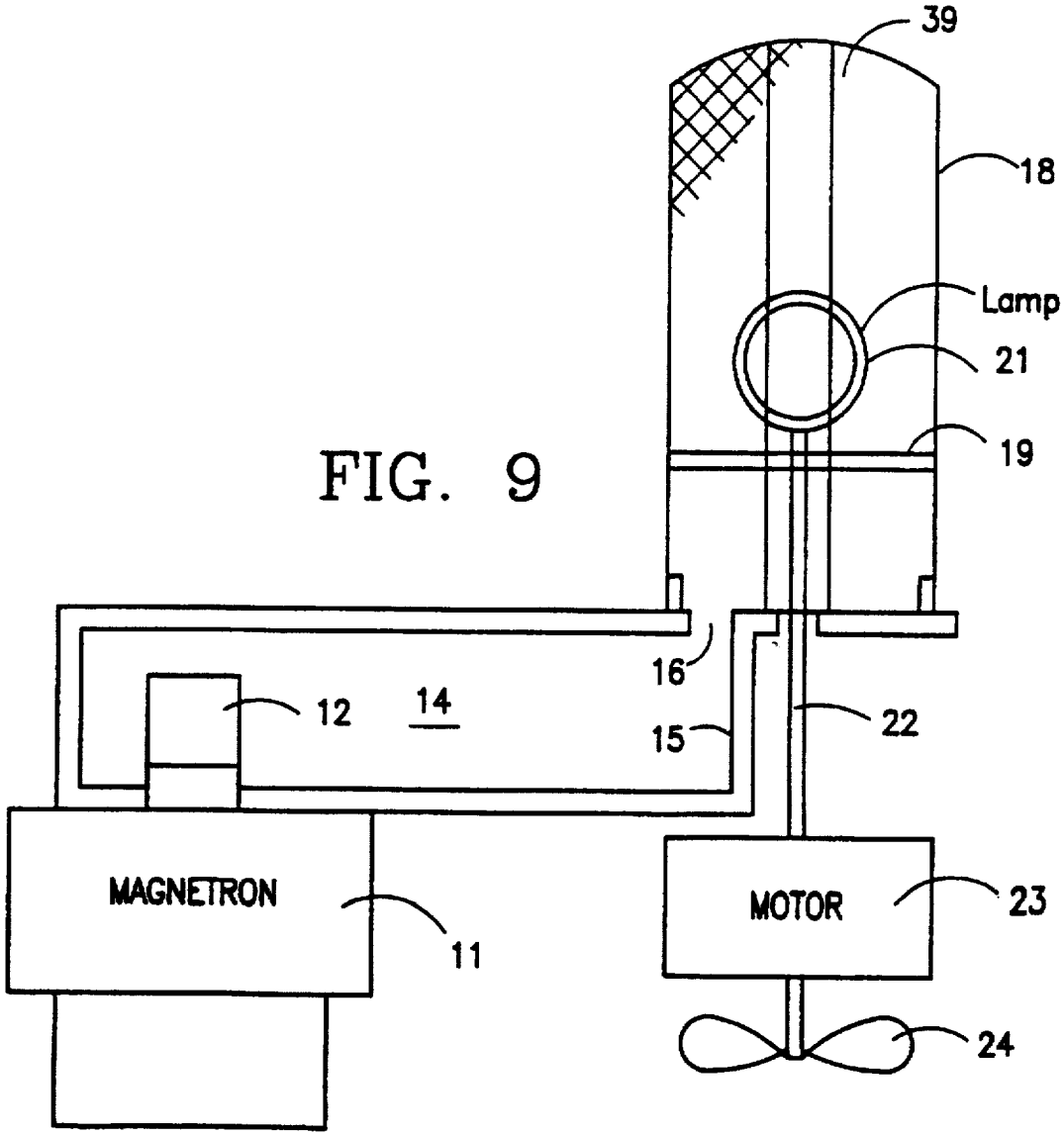
FIG. 9 illustrates another modification to a cylindrical cavity for increasing coupling to the second orthogonal mode.

FIGS. 9 and 10 represent an alternative distortion provided in a cylindrical cavity surface for increasing coupling to the orthogonal mode. The surfaces of the cavity 18 at 38 and 39 are substantially flat, producing a zero curvature along cavity 18 producing full length flats 38 and 39 along diametrically opposite portions of a cylindrical cavity 18.

Figure 12:
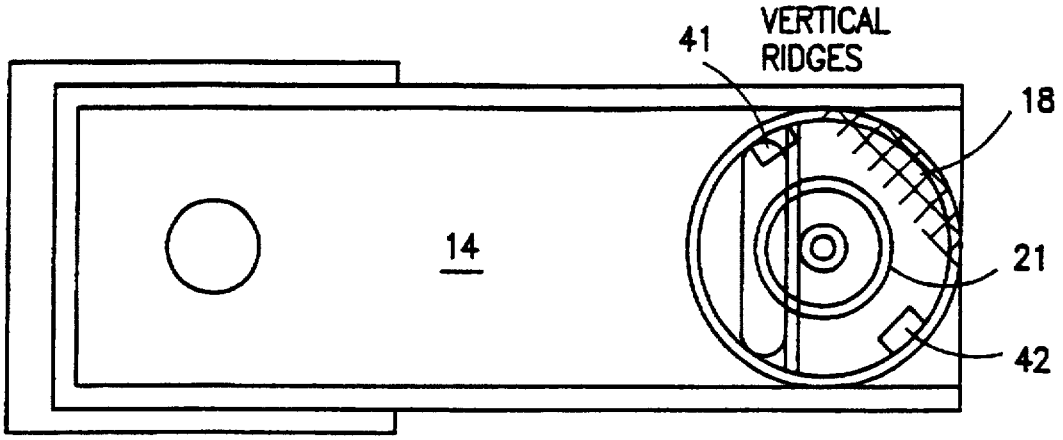
FIG. 12 is a top view of the device of FIG. 11.
Figure 11:
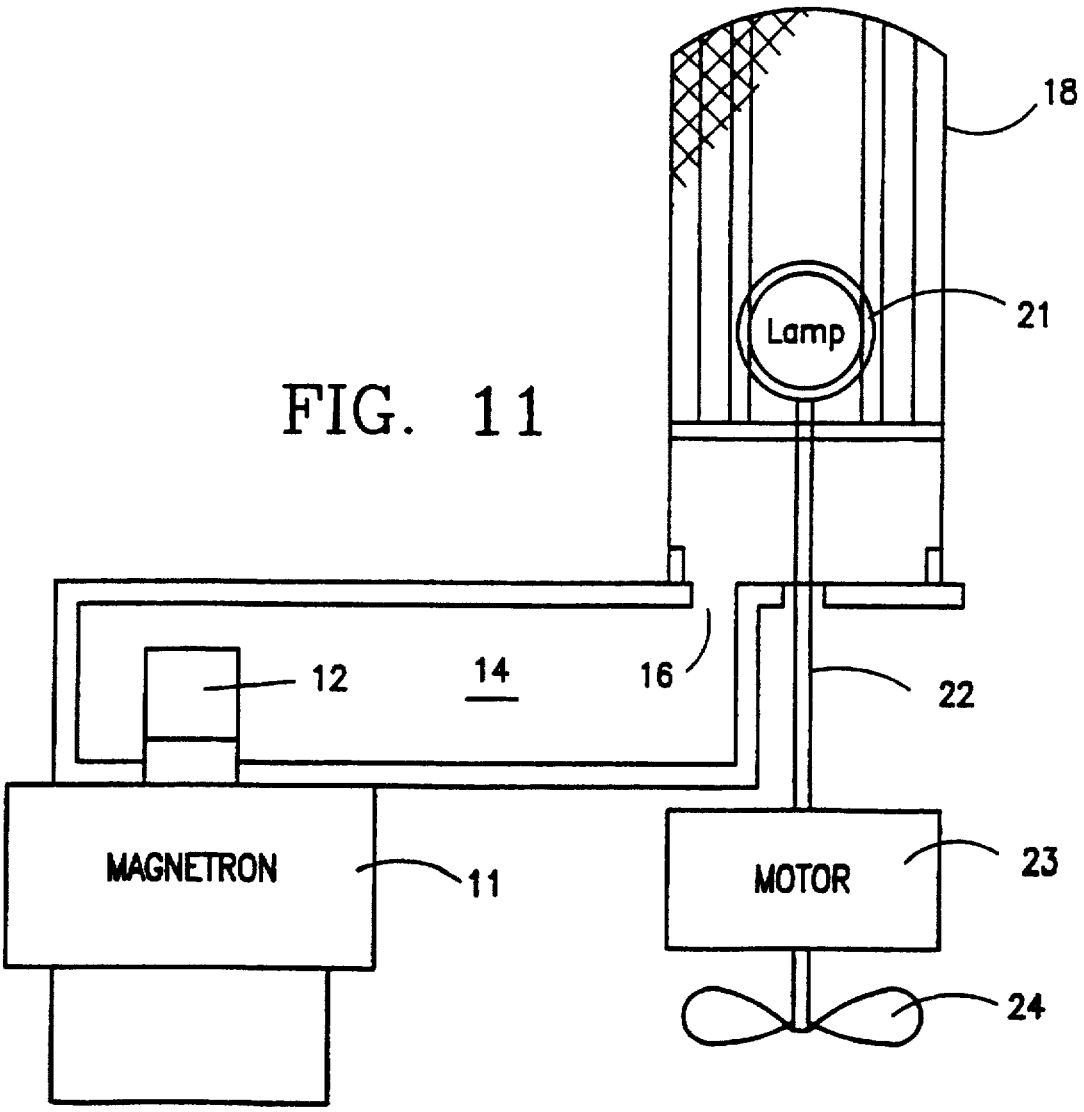
FIG. 11 is a plan view of a cylindrical cavity modified in accordance with another embodiment of the invention to increase the coupling of microwave energy through a second orthogonal resonant mode to an electrodeless lamp.

FIGS. 11 and 12 represent another embodiment where the cylindrical symmetry of the cylindrical cavity 18 is altered. Two vertical ridges 41, 42 are placed inside the cavity 18, in contact therewith. The altered symmetry results in an increase in coupling to the orthogonal mode.

The foregoing alterations to the circular cavity 18 may be implemented by, for example, applying a force to a circular screen constituting the cylindrical cavity. The screen surface is permanently deformed in the appropriate shape to change what was essentially a circular cavity into a nominally circular cavity, including surface portions which enhance the coupling of microwave energy from slot 16 into the second orthogonal mode for igniting of the lamp plasma. Those skilled in the art will recognize yet other embodiments defined by the claims which follow.

What is claimed is:

1. An apparatus for exciting an electrodeless lamp which has an impedance which changes from a first value when it is ignited, to a second steady state value following ignition comprising:

a source of microwave energy;

a rectangular waveguide coupled to said source of microwave energy, having a substantially rectangular slot along one wall thereof; and a cavity enclosing the electrodeless lamp, having an axis perpendicular to said wall with one end coupled to the slot, and having a second closed end, said cavity including a plurality of light emitting apertures, said cavity having a nominally cylindrical surface supporting a first mode of electromagnetic radiation from said slot, said surface including a portion which is not cylindrical which increases coupling of energy in a second mode of electromagnetic radiation from said slot, wherein said electromagnetic radiation of said second mode provides a large electric field component to said electrodeless lamp for igniting said lamp, and said first mode provides the majority of electromagnetic radiation to said lamp for sustaining illumination of said lamp following ignition.

2. The apparatus according to claim 1 wherein said first and second modes have electrical fields which are orthogonal to each other.

3. The apparatus according to claim 1 wherein said non-cylindrical portion is provided by reducing the curvature of a portion of said surface of said cavity.

4. The apparatus according to claim 3 wherein the curvature is reduced to provide a substantially flat portion on the surface of a cylindrical cavity.

5. The apparatus according to claim 1 wherein said non-cylindrical portion is created by providing a conductive body in contact with a surface of said nominally cylindrical surface.

6. The apparatus according to claim 1 wherein said non-cylindrical portion is provided by ridges in the end of a cylindrical cavity.

7. The apparatus according to claim 1 wherein said non-cylindrical portion includes a pair of tapered ridges in the surface of said nominally cylindrical portion.

8. The apparatus according to claim 1 further comprising a mirror located within said cavity to increase the useful light output of said electrodeless lamp.

9. The apparatus according to claim 1 wherein said non-cylindrical portion is located between said electrodeless lamp and said second end, wherein following ignition of said lamp, microwave energy reaching said non-cylindrical portion is reduced reducing energy reflected from said non-cylindrical portion.

10. An apparatus for exciting an electrodeless lamp which has an impedance which changes from a first value before ignition to a second value after ignition comprising:

a source of microwave energy;

a waveguide connected to said source of microwave energy, including along a wall thereof a slot; and a nominally cylindrical cavity which is coupled at one end thereof to said slot which supports microwave energy in first and second orthogonal modes, said cylindrical cavity being closed at a second end thereof and including an apertured surface which encloses the electrodeless lamp, said nominally cylindrical cavity having a surface portion which is non-cylindrical for increasing the coupling from said slot in said second mode, creating a high standing wave ratio in said cavity for igniting said lamp, wherein said nominally cylindrical cavity is subsequently loaded by said ignited lamp and supplied with microwave energy by said first mode with a reduction in energy coupled in said second mode to said lamp.

11. The apparatus according to claim 10 wherein said non-cylindrical portion is located between said second end and said electrodeless lamp, wherein after ignition said lamp dissipates most of said microwave energy in said cavity reducing the microwave energy incident to said non-cylindrical surface portion after ignition.

12. The apparatus according to claim 11 wherein said non-cylindrical portion of said cavity is formed from a portion of a cylindrical surface having a reduced curvature.

13. The apparatus according to claim 10 wherein said non-cylindrical portion are ridges formed in a cylindrical surface.

14. The apparatus according to claim 10 wherein said non-cylindrical portion comprises a deformed section of a cylindrical cavity.

15. An electrodeless microwave discharge lamp, comprising:

a microwave energy source;

a waveguide connected to the microwave energy source;

a cavity connected to the waveguide for coupling microwave energy in a first resonant mode during ignition and in a second resonant mode following ignition, wherein the second resonant mode primarily maintains illumination during steady state operation; and an electrodeless lamp, located within the cavity, containing a fill which emits light when excited by the microwave energy coupled to the electrodeless lamp by the cavity.

16. The electrodeless microwave discharge lamp according to claim 15, wherein the first resonant mode provides a high electric field for igniting the electrodeless lamp and wherein the second resonant mode provides an impedance matched coupling to the ignited electrodeless lamp during steady state operation.

17. The electrodeless microwave discharge lamp according to claim 15, wherein the cavity comprises a wall and an object in contact with the wall for modifying the microwave resonance characteristics of the cavity to couple more of the microwave energy to the electrodeless lamp in the first resonant mode.

18. The electrodeless microwave discharge lamp according to claim 15, wherein the cavity comprises a surface and a deformity along the surface for modifying the microwave resonance characteristics of the cavity to couple more of the microwave energy to the electrodeless lamp in the first resonant mode.

19. The electrodeless microwave discharge lamp according to claim 18, wherein the deformity comprises a ridge along the surface of the cavity.

20. The electrodeless microwave discharge lamp according to claim 19, wherein the ridge is tapered, with a wider portion of the ridge beginning at an end of the cavity distal to where the cavity is connected to the waveguide.

21. The electrodeless microwave discharge lamp according to claim 15, wherein the cavity comprises a nominally cylindrical surface having a non-cylindrical portion which modifies the microwave resonance characteristics of the cavity to couple more of the microwave energy to the electrodeless lamp in the first resonant mode.

22. The electrodeless microwave discharge lamp according to claim 21, wherein the non-cylindrical portion comprises an object in contact with the nominally cylindrical surface.

23. The electrodeless microwave discharge lamp according to claim 21, wherein the non-cylindrical portion comprises a deformity along the nominally cylindrical surface.

24. The electrodeless microwave discharge lamp according to claim 23, wherein the deformity comprises a ridge along the surface of the cavity.

25. The electrodeless microwave discharge lamp according to claim 24, wherein the ridge is tapered, with a wider portion of the ridge beginning at an end of the nominally cylindrical surface distal to where the cavity is connected to the waveguide.

* * * * *

UNITED STATES PATENT AND TRADEMARK OFFICE

CERTIFICATE OF CORRECTION

PATENT NO : 5,786,667

DATED : July 28, 1998

INVENTOR(S): SIMPSON, James E., et al.

It is certified that error appears in the above-identified patent and that said Letters Patent is hereby corrected as shown below:

Column 1, line 4, insert the following paragraph:

-- This invention was made with Government Support under Contract No. NAS10-12114 awarded by the National Aeronautics and Space Administration. The Government has certain rights in this invention.--

Signed and Sealed this

Nineteenth Day of January, 1999

*Attest:*

*Attesting Officer*

*Acting Commissioner of Patents and Trademarks*